United States Patent [19]

Oldrieve et al.

[11] 4,055,416

[45] Oct. 25, 1977

[54] TANTALUM MODIFIED FERRITIC IRON BASE ALLOYS

[75] Inventors: Robert E. Oldrieve, Bay Village; Charles P. Blankenship, Rocky River, both of Ohio

[73] Assignee: The United States of America as represented by the Administrator of the National Aeronautics and Space Administration, Washington, D.C.

[21] Appl. No.: 651,009

[22] Filed: Jan. 21, 1976

[51] Int. Cl.[2] ..... C22C 38/06; C22C 38/26; C22C 38/48

[52] U.S. Cl. ..... 75/124; 75/126 D; 75/126 F; 75/128 G; 75/128 T

[58] Field of Search ..... 75/124, 126 C, 126 D, 75/126 F; 148/37; 115/128 G, 128 T

[56] References Cited

U.S. PATENT DOCUMENTS

| | | | |
|---|---|---|---|
| 2,191,790 | 2/1940 | Franks | 75/126 F |
| 3,499,802 | 3/1970 | Lagneborg | 148/37 |
| 3,852,063 | 12/1974 | Nilmi et al. | 75/126 D |
| 3,890,143 | 6/1975 | Skoglund et al. | 75/126 D |

*Primary Examiner*—Arthur J. Steiner
*Attorney, Agent, or Firm*—N. T. Musial; G. E. Shook; John R. Manning

[57] ABSTRACT

Strong ferritic alloys of the Fe-Cr-Al type containing 0.4% to 2% tantalum have improved fabricability without sacrificing high temperature strength and oxidation resistance in the 800° C (1475° F) to 1040° C (1900° F) range.

5 Claims, No Drawings

TANTALUM MODIFIED FERRITIC IRON BASE ALLOYS

ORIGIN OF THE INVENTION

The invention described herein was made by employees of the United States Government and may be manufactured or used by or for the Government without the payment of any royalties thereon or therefor.

BACKGROUND OF THE INVENTION

This invention relates to improved iron base alloys having ferritic body-centered cubic micro-structures. The invention is particularly directed to tantalum modified ferritic iron base alloys having improved high temperature mechanical properties and oxidation resistance. These alloys are particularly useful in high temperature applications including furnace linings, flue stacks, and the like.

Ferritic iron base alloys, both with and without the addition of aluminum, have been available as Series 400 stainless steels, chromium-molybdenum-vanadium steels with less than 0.1 weight percent carbon and iron-nickel magnetic compositions. Aluminum added to these materials in the amount of a few percent generally assures that the alloy remains ferritic and free of damaging allotropic phase transformations. This aluminum addition further contributes to corrosion resistance as well as resistance to scaling, and the presence of aluminum is sometimes used to control grain size.

Chromium added in addition to aluminum provides resistance to oxidation and corrosion at very high temperatures up to 1,290° C. Such alloys are used almost exclusively as resistor heating elements and have compositions containing chromium in excess of 23% together with 5% aluminum. Recently developed ferritic alloys with 18% chromium and 2% aluminum, as well as AISI 405 stainlss steel have received attention for high temperature applications where strength is not a requirement.

The principal disadvantage of these prior art ferritic iron base alloys is that they lost their ultimate strength and rupture strength at temperatures in excess of 650° C. When present day ferritic iron-chromium-aluminum alloys are utilized at higher temperatures, the alloys lack sufficient strength to support their own weight, and they have unsatisfactory corrosion resistance when combined with even moderate loads. Thus, such alloys have not been used in high temperature applications above 800° C.

SUMMARY OF THE INVENTION

The alloys of the present invention are for use primarily at temperatures in the 800°-1040° C range. The alloys have excellent oxidation resistance with greatly improved high temperature strength. The iron base alloys of the present invention are ferritic body-centered cubic micro-structure with the following composition weight percent: 15-20% chromium, 2-4% aluminum, 0.4-2.0% tantalum, 0.01-0.05% carbon, manganese about 0.5%, phosphorous about 0.02%, sulphur about 0.01%, and the balance iron.

OBJECTS OF THE INVENTION

It is, therefore, an object of the present invention to provide new alloys having excellent oxidation resistance and greatly improved strength properties at elevated temperatures. Another object of the invention is to provide improved alloys by the addition of about 0.4% to about 2% by weight tantalum to ferritic iron-base alloys containing about 1% silicon, 18% chromium, 2% aluminum, 0.4% titanium, and 0.04% carbon such that the alloy is strengthened by carbides as well as by solid solutioning and with freedom from formation of damaging phases upon long term exposure at elevated temperatures.

A further object of the invention is to provide novel alloys having improved strength properties at elevated temperatures while retaining the excellent oxidation resistance of ferritic iron-chromium-aluminum alloys without loss of fabricability or weldability.

These and other objects of the invention will be apparent from the specification which follows:

DESCRIPTION OF A PREFERRED EMBODIMENT

Alloys made in accordance with the present invention have compositions by weight in the following ranges:

Chromium — 15.0% to 20.0%
Aluminum — 2.0% to 4.0%
Silicon — 0.4% to 1.0%
Titanium — 0.4% to 1.0%
Nickel — 0.4% to 1.0%
Carbon — 0.01% to 0.05%
Manganese — 0.0% to 0.5%
Phosphorous — 0.0% to 0.02%
Sulphur — 0.0% to 0.01%
Tantalum — 0.4% to 2.0%
Iron — Balance The preferred alloy in the above range has the following composition by weight:

Chromium — 18%
Aluminum — 2%
Silicon — 1%
Titanium — 0.4%
Carbon — 0.04%
Tantalum — 1.3%
Iron — Balance Another preferred alloy has the same as above with the exception that the tantalum is reduced to about 0.5%.

The 15-20% chromium is required for the maintenance of oxidation resistance for long term exposure. In combination with at least 2% aluminum, the chromium provides a stable alpha phase alloy structure.

Tantalum in the amount of at least 0.4% provides strengthening by solid solution of a large diameter atomic constituent. Tantalum further provides for the fine distribution of carbides which offer resistance to grain-boundary sliding. Tantalum offers other advantages heretofore not recognized, as will be seen by a further description of the alloys.

Carbon in amounts of 0.01-0.05% is required to provide for precipitated carbides essential to strengthening. Titanium, nickel, and silicon in the amount of about 0.4 - 1.0% each are representative of the type of additional elements which are included to provide resistance to grain boundary oxidation in iron base alloys with less than about 3.0% aluminum. In addition to the aforementioned constituents, the alloys contain up to about 0.5% manganese, up to 0.5% nickel, and small amounts of phosphorous and sulphur.

The actual compositions of alloys made in accordance with the invention are set forth in Table I.

TABLE I

COMPOSITIONS OF FERRITIC IRON-BASE ALLOYS

| Alloy No. | Composition, wt. % | | | | | | | | | | | |
|---|---|---|---|---|---|---|---|---|---|---|---|---|
| | C | Mn | Si | Cr | Ni | Ta | Mo | Nb | Al | Ti | P | S |
| 1 | .038 | 37 | 1.14 | 17.74 | .17 | 0.45 | 0 | 0 | 2.10 | .44 | .008 | .012 |
| 2 | .040 | .37 | 1.28 | 17.76 | .20 | 1.25 | 0 | 0 | 2.10 | .45 | .007 | .014 |
| 3 | .041 | .5 | 1.01 | 17.91 | 0 | 0 | 2.04 | 0.58 | 2.19 | 0 | 0 | 0 |
| 4 | .010 | .001 | .05 | 14.72 | 0 | 0.91 | 0 | 0 | 4.27 | 0 | .002 | .003 |
| 5 | .012 | .001 | .05 | 15.23 | 0 | 1.97 | 0 | 0 | 5.35 | 0 | .002 | .004 |
| 6 | .041 | .3 | .1 | 14.37 | 0 | 0 | 2.02 | 0.53 | 4.72 | 0 | 0 | 0 |

A comparison of the as-fabricated stress to rupture properties of several of the alloys shown in Table I with those of an existing commercial product are shown in Table II wherein the samples were die punched from as-rolled, sheet-sheet stock of 1.6 mn thickness. The commercial Fe-Cr-Al alloy (A) had a nominal composition of 18% Cr, 1% Si, 2% Al, 0.4% Ti, 0.04% C, and the balance Fe.

TABLE II

STRESS TO RUPTURE DATA FOR Fe-Cr-Al ALLOYS

| Alloy | Rupture Strength MN/m² | | | |
|---|---|---|---|---|
| | 1000° C | | 800° C | |
| | 100 hrs. life | 1000 hrs. life | 100 hrs. life | 1000 hrs. life |
| 1 | 4.4 | 2.8 | 17.2 | 10.7 |
| 2 | 5.5 | 3.5 | 22.8 | 14.0 |
| A | 3.0 | 1.9 | 11.4 | 7.0 |

A tantalum addition to the preferred alloys clearly provides a substantial increase in the high temperature load carrying capacity over that of a commercial alloy (A) which contains no tantalum. A comparison of the data in Table II for 100 hour rupture life shows an improvement of 82% at 1,000° C and of 100% at 800° C for the preferred alloy (No. 2) containing 1.3% Ta over the data obtained for the commercial alloy (A). The rupture strength improvement is retained for 1,000 hours of life at which alloy No. 2 can sustain an 85% greater stress at 1,000° C and 100% at 800° C.

The second preferred composition, alloy No. 1 in Table I which contains only 0.5% Ta, exhibited a rupture strength advantage of 45% to 51% for 100 hours at 1000° and 800° C, respectively. Alloy 1 further showed a rupture strength advantage of 52% to 55% for 1,000 hours at the test temperatures of 1,000° C and 800° C, respectively.

Comparisons of rupture life at temperatures and the weight loss of the alloys for a fixed exposure time using cyclic oxidation test conditions are shown in Table III. All the oxidation data are cyclic furnace test results for one hour at temperature for each cycle.

TABLE III

RUPTURE LIFE AND OXIDATION RESISTANCE

| Alloy | Rupture Life | | Oxidation Resistance |
|---|---|---|---|
| | 800° C at 10 Mn/m² Hrs | 1000° C at 3.5 Mn/m² Hrs | 600 hrs at 1140° C wt. change mg/cm² |
| 1 | 2010 | 340 | +2.8 |
| 2 | 5500 | 1000 | +3.0 |
| 6 | 1800 | 100 | +4.0 |
| A | 210 | 50 | +8.0 |
| B | 230 | 16 | −17.0 Failed at 485 hours |

Commercial alloy B had a nominal composition of 15% Cr, 4% Al, 0.007% C and the balance Fe.

A comparison of the data in Table III shows that new alloy 2 provides about 25 times the life of commerical alloy A at 800° C and 20 times its life at 1,000° C. Also new alloy 2 has only one half the cyclic oxidation weight change of commercial alloy A at 1140° C.

Alloy 1 privdes a 10-fold and 7-fold longer life than commercial alloy A at 800° and 1000° C, respectively. Alloy 1 also provides increased oxidation resistance over the existing commercial alloys.

Table III also shows a comparison of the increased life and remarkably increased oxidation resistance which the addition of 2% Mo and 0.5% Nb provides a ferritic Fe-Cr-Al when about 0.04% C is added in combinaion with these elements.

Alloy 2 has exhibited superior performance characteristics in automobile pollution control devices. Full size exhaust manifold thermal reactors were fabricated of alloy 2 as well as commercial alloy A. The thermal reactors were operated until the reactor core cracked or was penetrated by oxidation. The alloy 2 reactor core was removed from test, unfailed, after 760 hours of exposure. The alloy 2 lost less than one third the weight due to oxidation of the core than that lost by the commercial alloy A reactor.

While a preferred compositon range has been described for the alloys, it will be appreciated that various modifications may be made to these compositions without departing from the spirit of the invention or the scope of the subjoined claims.

What is claimed is:

1. A ferritic steel alloy having improved high temperature strength at temperatures to 1,040° C, improved oxidation resistance to 1,150° C, and good cold formability consisting essentially of, in weight percents;

15.0% to 20.0% chromium, 2.0% to 4.0% aluminum, 0.4% to 1.0% silicon, 0.4% to 1.0% titanium, 0.01% to 0.05% carbon, 0.4% to 1.5% tantalum and the balance iron.

2. An alloy as claimed in claim 1 containing about 18% chromium, 2% aluminum, 1% silicon, 0.4% titanium, 0.04% carbon, 0.5% to 1.3% tantalum and the balance Fe.

3. An alloy as claimed in claim 2 containing about 1.3% tantalum.

4. An alloy as claimed in claim 2 containing about 0.5% tantalum.

5. An alloy as claimed in claim 1 containing about 0.4 to 1.0% nickel, 0.5% manganese, 0.02% phosphorous and about 0.01% sulfur.

* * * * *